US005494004A

United States Patent [19]

Hunter, Jr.

[11] Patent Number: 5,494,004

[45] Date of Patent: Feb. 27, 1996

[54] ON LINE PULSED DETONATION/DEFLAGRATION SOOT BLOWER

[75] Inventor: Louis G. Hunter, Jr., Ft. Worth, Tex.

[73] Assignee: Lockheed Corporation, Fort Worth, Tex.

[21] Appl. No.: 310,870

[22] Filed: Sep. 23, 1994

[51] Int. Cl.[6] ..... F22B 37/48

[52] U.S. Cl. ..... 122/395; 122/379; 122/390; 165/95

[58] Field of Search ..... 122/379, 390, 122/395; 165/95

[56] References Cited

U.S. PATENT DOCUMENTS

| | | | |
|---|---|---|---|
| 3,782,336 | 1/1974 | Nelson | 122/379 |
| 4,209,028 | 6/1980 | Shenker | 134/56 R |
| 4,827,953 | 5/1989 | Lee | 134/172 |
| 5,031,691 | 7/1991 | Boisture | 165/95 |
| 5,092,280 | 3/1992 | Franklin et al. | 122/379 |
| 5,194,217 | 3/1993 | St. Louis et al. | 376/316 |

*Primary Examiner*—Henry A. Bennett
*Assistant Examiner*—Siddharth Ohri
*Attorney, Agent, or Firm*—Arthur F. Zobal

[57] ABSTRACT

A pivotal housing member has an end pivotally coupled to an end of a base housing member for movement between a retracted or folded position and an extended position. The pivotal housing member has a pulsed deflagration or detonation device located therein for producing pulsed deflagration or detonation pressure waves for cleaning purposes. When the pivotal member is in its folded position, the two housing members may be moved through the opening formed through the wall of a boiler, etc. for cleaning the interior surface of the wall with the pulsed pressure waves. In order to increase the wall area cleaned from a given wall opening, the two housing members may be rotated about an axis of the base housing member and the pivotal housing member pivoted to different extended positions from its folded position.

18 Claims, 8 Drawing Sheets

25
21A
23
271
273

35
31A
33
293
291

33
201
187
187A
203
281
31

21
31A
21A
23
273
271

Fig. 13
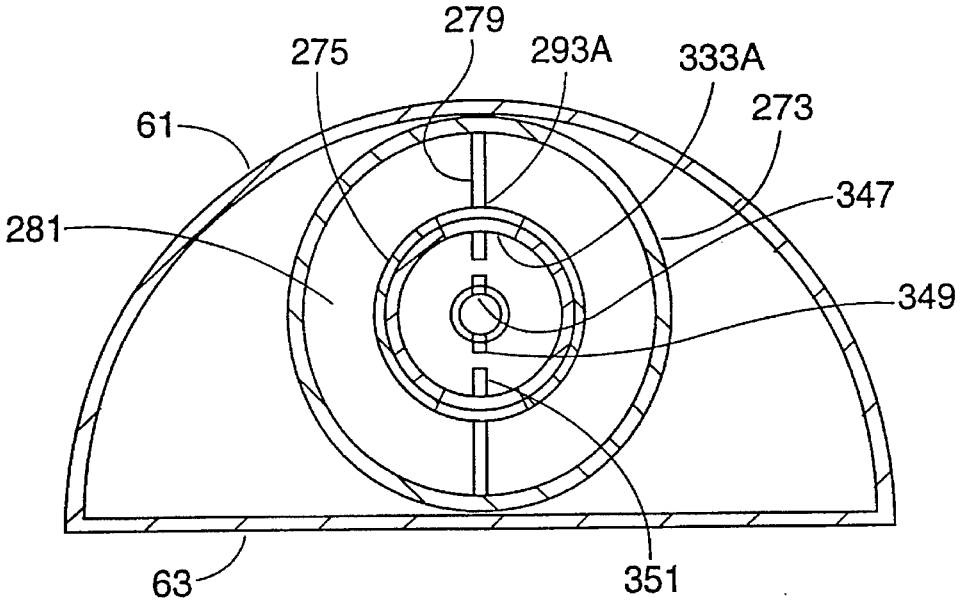
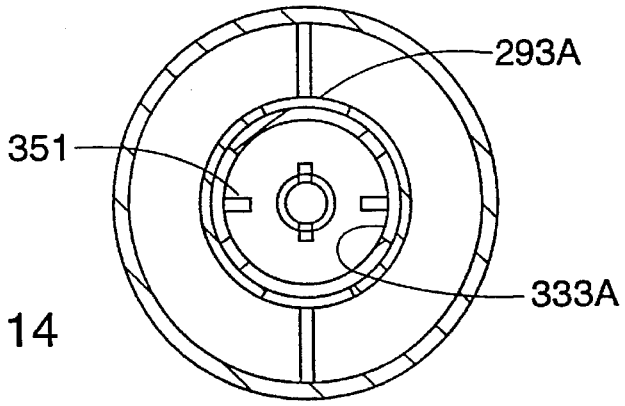
Fig. 14
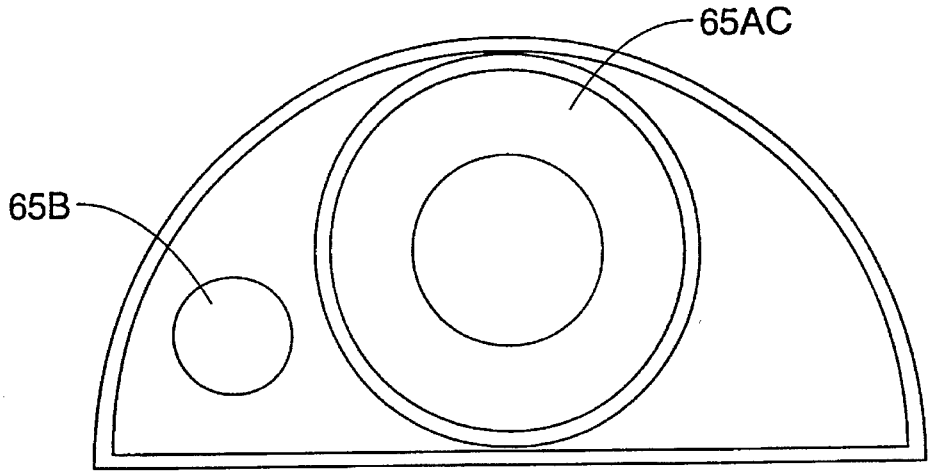
Fig. 15

ON LINE PULSED DETONATION/DEFLAGRATION SOOT BLOWER

FIELD OF THE INVENTION

The invention relates to an apparatus for use for cleaning soot and slag from the inside walls of coal power plants etc.

BACKGROUND OF THE INVENTION

Coal power plants (boiler and gasifiers) can have their efficiency improved from 1–5% by using on line pulse-combustion slag blasters to reduce or eliminate slag. Steady state soot blowers are not effective for most coals, where repetitive shock waves are necessary to minimize slag formation. Boiler heat cannot be effectively radiated or convected to boiler tubes covered with slag. Slag buildup is slated to increase in the future as different coals are burned and more efficient Nox cycles are incorporated. Slag removal efficiencies will lead to pervasive SO2 reductions of 75 pounds per ton of coal saved due to efficient slag removal. At a 1% improvement due to slag reduction, using the North American coal consumption, SO2 emissions will be reduced by 714 million pounds per year.

SUMMARY OF THE INVENTION

It is an object of the invention to provide an apparatus for cleaning the interior walls of a heat producing system with increased wall area coverage obtained from a given inlet opening formed through the wall to be cleaned.

The apparatus of the invention comprises first and second elongated housing members with one end of the second housing member being pivotally coupled to one end of the first housing member to allow the second housing member to be pivoted between a folded position and an extended position. When the second housing member is in its folded position, the two housing members may be moved through an inlet opening formed through the wall of the heat producing system. In the interior of the heat producing system, fluid is injected from the outlet end of the second housing member for cleaning the walls of the heat producing system. In order to increase the wall area cleaned from a given inlet opening, the two housing members may be rotated about an axis of the first housing member and the second housing member pivoted to different extended positions from its folded position.

In one aspect, an apparatus is located in the second housing member for periodically producing a deflagration pressure wave for application through the outlet end of the second housing member for cleaning purposes. In another embodiment, the pulsed apparatus is a unique device for periodically producing a detonation pressure wave for cleaning purposes. Fuel and air (and oxygen/air for the detonation device) are fed to the pulsed apparatus by way of the first housing member.

In another aspect, the two housing members each comprise surrounding walls with wall structure of the second housing member at its pivotally coupled end overlapping the wall structure of the first housing member at its pivotally coupled end when the second housing member is located at any of its positions between its folded and extended positions for protecting the interior components of the two housing member from the heat of the heat producing system.

The walls of the two housing materials are made of special heat resistant materials, which are water cooled.

BRIEF DESCRIPTION OF THE DRAWINGS

In FIG. 5, two guide and support members are shown which are not shown in FIGS. 1–4.

FIG. 13 is a cross-sectional view of FIG. 12 as seen along lines 13—13 thereof.

FIG. 14 is a view similar to that of FIG. 13 but with the rotary valve rotated 90 degrees.

FIG. 15 is an end view of the device of FIG. 12 as seen along lines 15—15 thereof.

DESCRIPTION OF THE PREFERRED EMBODIMENTS

Figure 1:
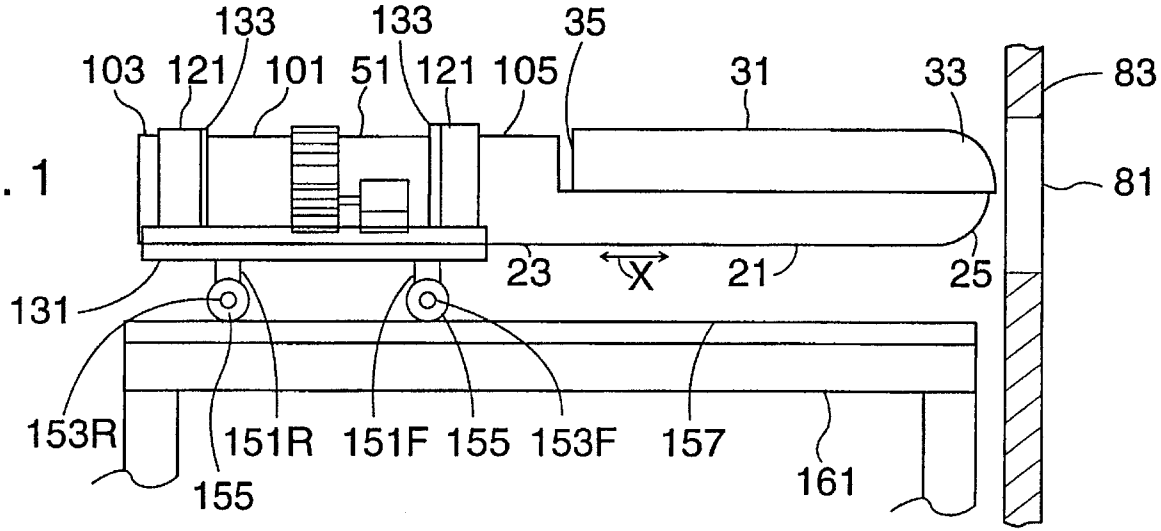
FIG. 1 is a side view of the apparatus of the invention with its pivotally coupled housing member in a folded position ready to be moved through an inlet opening of the wall of a boiler, etc.
Figure 2:
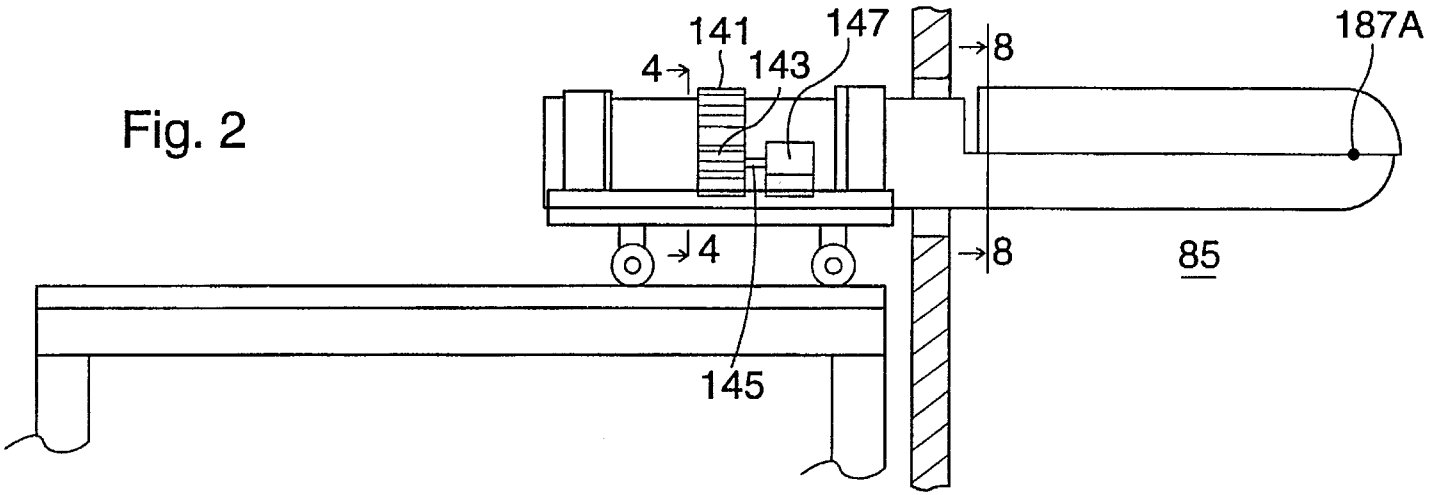
FIG. 2 is a view similar to that of FIG. 1 with the apparatus extending through the inlet opening of the wall of a boiler etc. and with its pivotally coupled housing member in a folded position.
Figure 3:
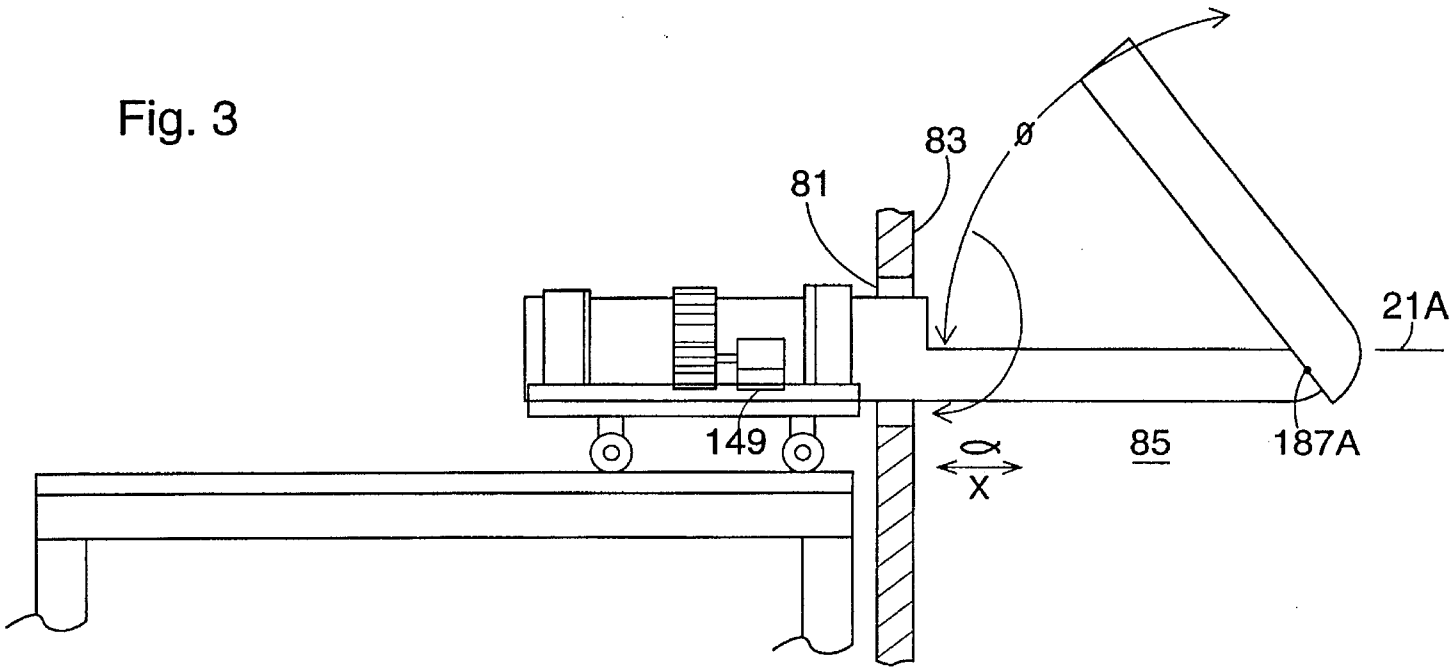
FIG. 3 is a view similar to that of FIG. 2 with the pivotally coupled housing member in an extended position.
Figure 4:
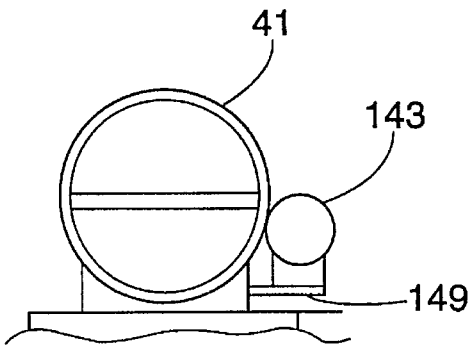
FIG. 4 is a cross-sectional view of FIG. 2 as seen along lines 4—4 thereof.

Referring now to FIGS. 1–3 and 8 of the drawings, the apparatus of the invention comprises an elongated base or first housing member 21 having ends 23 and 25 and a pivotal housing member 31 having ends 33 and 35. The end 33 of member 31 is pivotally coupled to end 25 of member 21 for movement between a folded or retracted position as shown in FIGS. 1 and 2 and an extended position as shown in FIG. 3.

Figure 8:
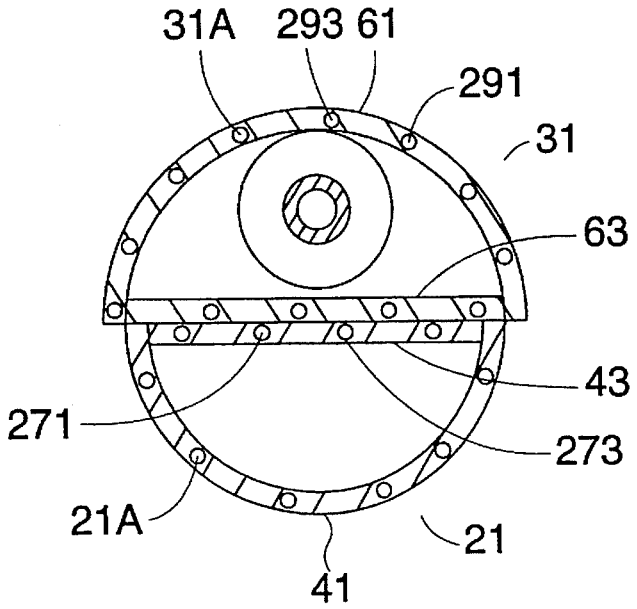
FIG. 8 is a cross-section of FIG. 2 taken along the lines 8—8 thereof illustrating the cooling tubes of the walls of the two housing members.

The housing member 21 is a half cylinder as shown in FIG. 8. In this respect, member 21 comprises a rounded wall 41 which in cross section form one half of a circle and a flat wall 43 connected to wall 41. End 25 of member 21 forms a half of a hemisphere and its end 23 is connected to an exterior portion 51 which is cylindrical in shape.

The housing member 31 also is a half of a cylinder as shown in FIG. 8. In this respect, member 31 comprises a rounded wall 61 which in cross section forms one half of a circle and a flat wall 63 connected to wall 61. The radius of wall 61 is greater than that of wall 41. The end 33 of member 31 forms a half of a hemisphere and overlaps the end 25 of member 21 at all times when the member 31 is in its retracted or extended positions to form a protective cover for the components inside members 21 and 31.

Figure 7:
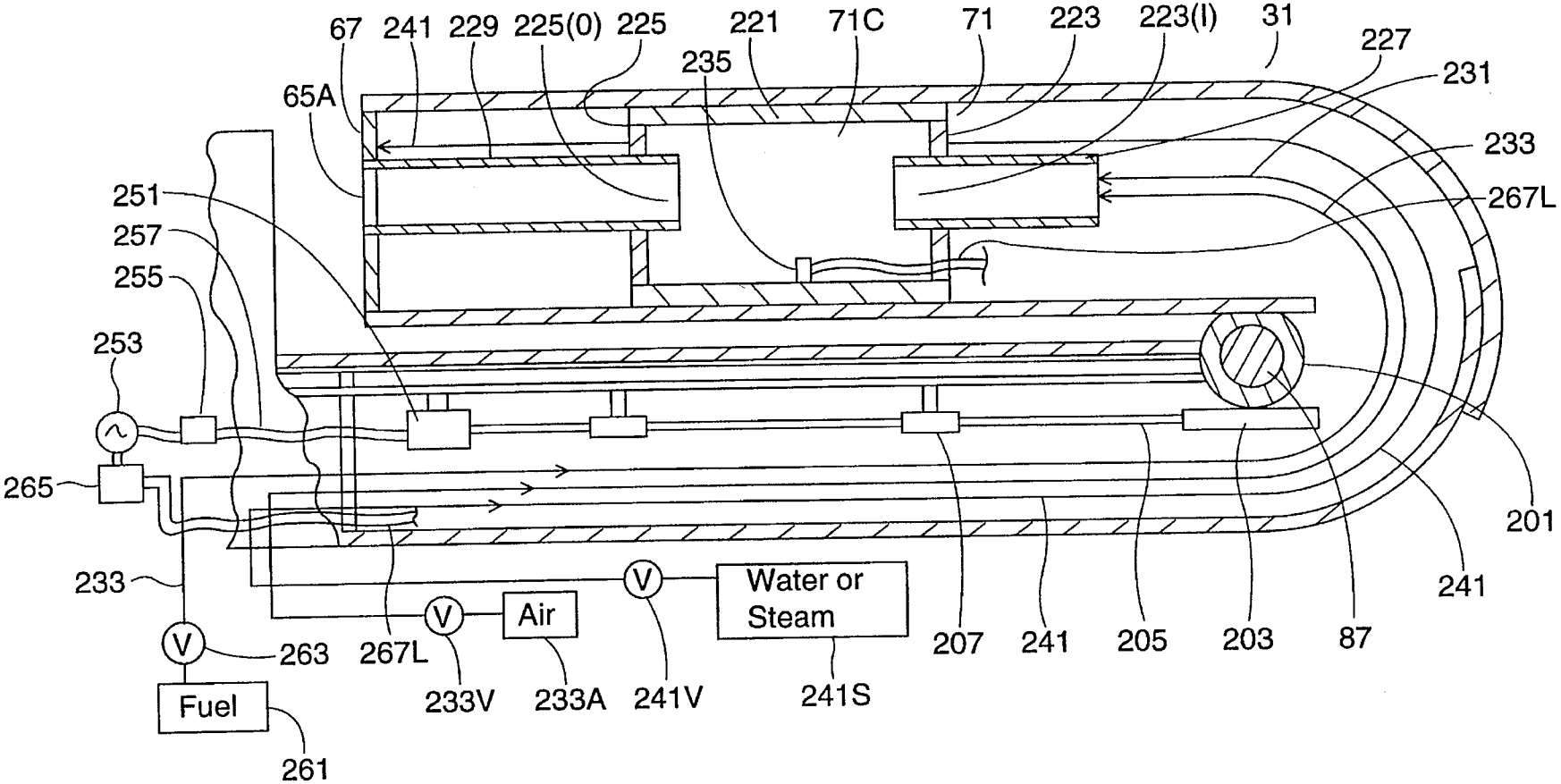
FIG. 7 is a cross-sectional side view of the two housing members illustrating the internal components, fluid and electrical lines, and control systems.

Located in member 31 is a pulsed deflagration combustor 71, as shown in FIG. 7, for producing a pulsed pressure wave for application through an opening 65A formed through end 67 of member 31 for cleaning purposes.

The exterior portion 51 is supported for movement in the X direction to insert members 21 and 31 into and to remove them from the interior zone 85 of the boiler. Passage is by of an opening 81 formed through the boiler wall 83. The members 21 and 31 are inserted through the opening 81 to clean the interior surface of wall 83 of the boiler.

The exterior portion 51 also can be rotated in the direction alpha to rotate the members 21 and 31 about the axis 21A of the member 21. Means is provided for pivoting the member 31 between a folded position as shown in FIGS. 1 and 2 to an extended position through a maximum angle theta as shown in FIG. 3 for cleaning purposes.

In order to clean the inside of wall 83, the exterior unit 51 is moved to move the members 21 and 31, when retracted, through the opening 81. the pulsed combustor 71 is operated as the member 31 is rotated to different positions about the axis 21A and pivoted to different positions relative to the member 21 to clean the wall 360 degrees about the opening 81 to a radius depending on the maximum position to which the member 31 is pivoted along the angle theta.

When cleaning operations are completed, the member 31 is retracted and the member 51 moved rearward to move the members 21 and 31 outward through the opening 81 and the cleaning procedure is repeated about another opening formed through wall 83.

The exterior member 51 comprises a cylindrical wall 101 having a rear end 103 and a forward end 105. The rear end 23 of the half cylindrical wall 41 is connected to half of the forward end 105 of the wall 101. Member 51 is supported for rotation about the axis 21A by bearing members 121 connected to a platform 13 1. Annular stops 133 are connected to the member 51 and engage the bearing members 121 to maintain the member 51 in the same axial position relative to the platform 131. An annular gear 141 is secured around the wall 101 of member 51 which is engaged by a gear 143 which is connected to a shaft 145 driven by a motor 147. Motor 147 is fixedly connected to the platform 131 by bracket 149. Actuation of the motor 147 rotates the shaft 145 and gear 143 to rotate the gear 141 and hence the member 51 about the axis 21A. This causes the members 21 and 31 to rotate about the axis 21A.

The platform 131 has two front legs 151F and two rear legs 151R, an axle 153F extending between the front legs 151F, and an axle 153R extending between the rear legs 151R. Connected to opposite ends of each axle are pinion gears 155 which mesh with two rack gears 157 which are secured to a movable base member 161. A reversible motor 153M fixedly connected to the platform 131 by bracket 159 has two shafts which form the axle 151R for driving the platform forward or rearward in the X direction. L shaped guide members 171 have lower ends 171L secured to the base 161 and upper inward extending ends 171E which slidable fit against the side L-shaped surfaces 131S of the platform 131 to guide and support the platform 131 as it moves.

Figure 6:
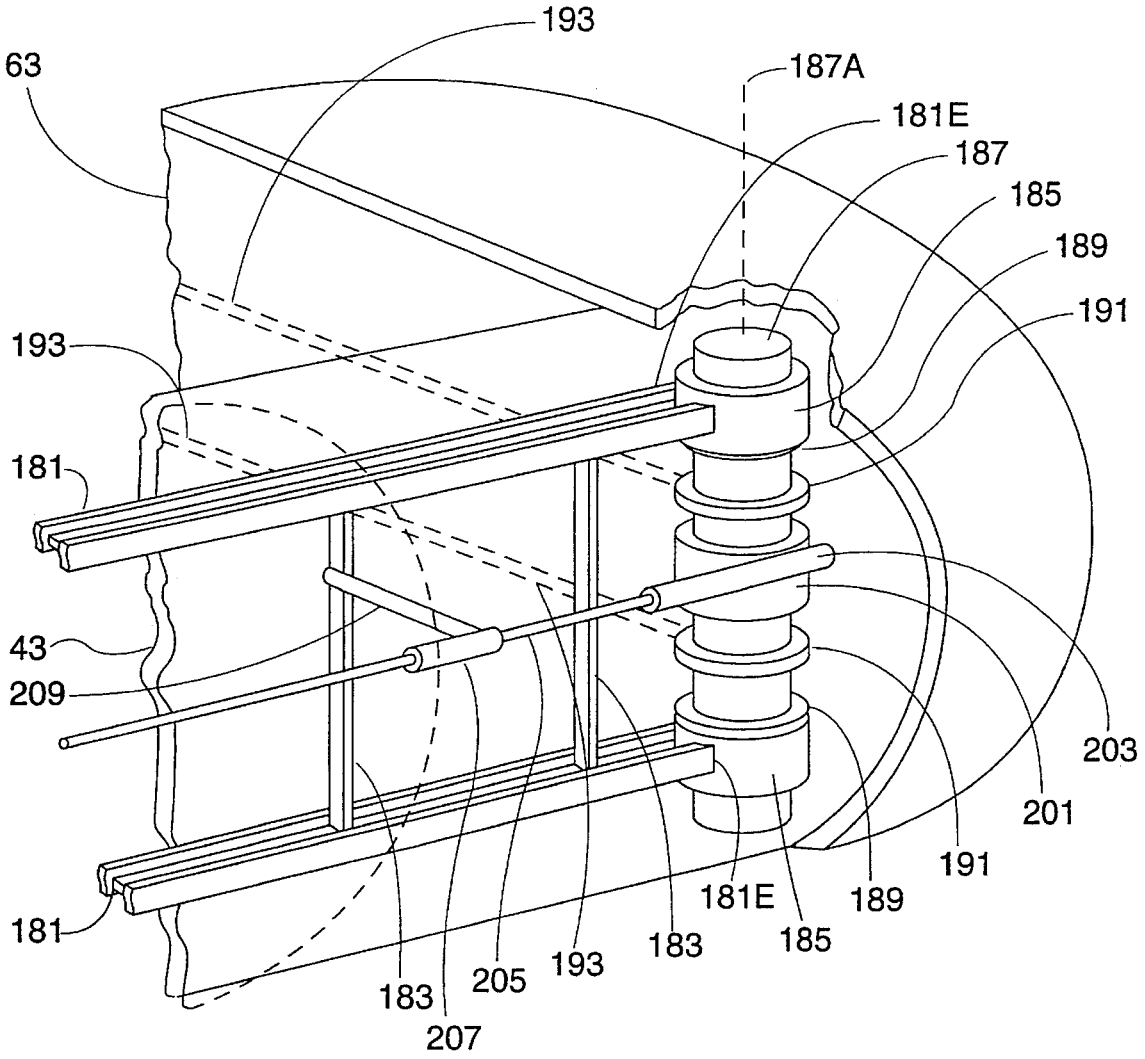
FIG. 6 is a partial cross-sectional view of the pivotally coupled ends of the two housing members illustrating the hinge and control thereof and structural components of the two housing members.

Referring to FIG. 6, metal I-beams 181 having cross beams 183 connected therebetween have sleeves 185 connected to outer ends 181E for supporting an axle 187 for rotation therein. The sleeves 185 carry inner bearings (not shown). Annular stops 189 which engage the sleeves 185 are connected to the axle 187 to prevent axial movement thereof. The wall 43 of member 21 is connected to the I-beams 181 and the wall 43 and the I-beams 181 extend into the annular member 51 to its rear end 103 and are connected thereto to provide support for the axle 187.

Secured to the axle 187 are two annular sleeves 191 to which rods 193 are secured. The wall 63 of member 31 is secured to the rods 193. Thus, rotation of the axle 187 within the sleeves 187 causes the housing member 31 to rotate or pivot about the axis 187A of the axle 187.

Secured to the axle 187 is a partial annular gear 201 to which is meshed a worm gear 203 which is supported for rotation by a shaft 205 supported by sleeves 207. Rods 209 are connected to the sleeves 205 and to the cross rods 183 to support the sleeves 205. Rotation of the gear 203 in one direction causes the member 31 to rotate or pivot to its retracted position and rotation of the gear 203 in an opposite direction causes the member 31 to pivot to its extended position.

Referring to FIG. 7, the pulsed combustor 71 comprises an annular wall 221 with two end walls 223 and 225 with inlet and outlet openings 223(I) and 225(O) forming a combustion chamber 71C. An inlet tube 227 is coupled to inlet opening 223(I) and an outlet tube 229 is coupled to outlet opening 225(O). Tube 229 extends to outlet opening 65A formed in end wall 67. Compressed air is continuously fed into the chamber 71C by way of tube 231 and a combustible gas under pressure such as propane is fed into the chamber 71C by way of tube 233. A spark plug 235 is located in the chamber 71C to periodically ignite the combustible mixture formed in the chamber 71C for producing deflagration. Thus, a pulsed pressure wave of fluid gas is injected through the outlet opening 65 for cleaning purposes.

Figure 5:
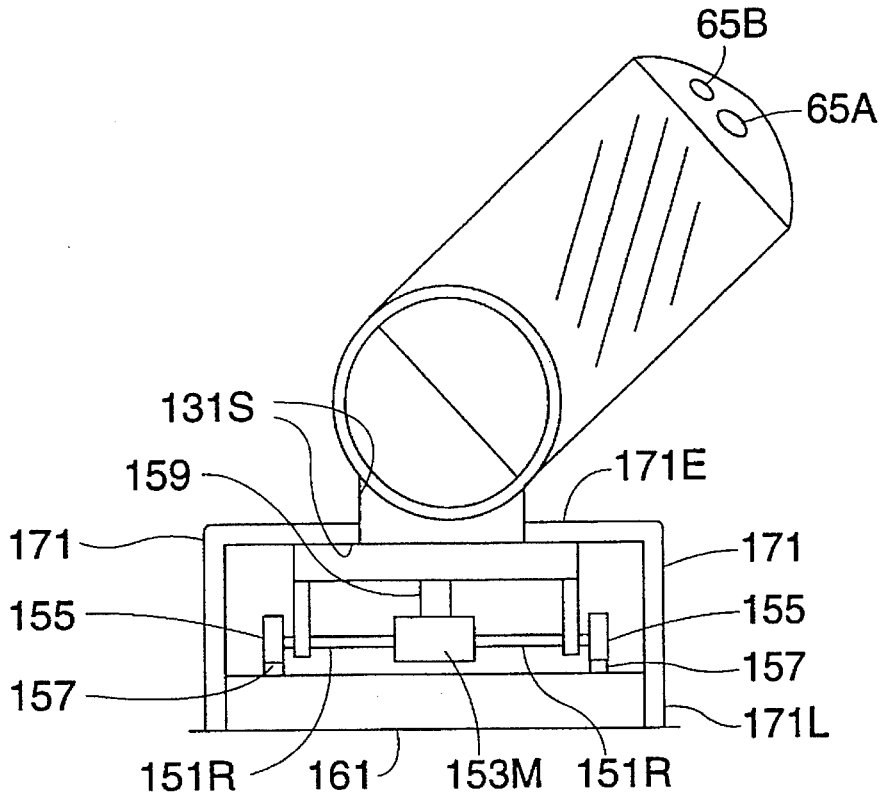
FIG. 5 is a rear view of the apparatus of the invention with the two housing members rotated 45 degreed from that of FIG. 3 and with the pivotally coupled housing member in an extended position.

In addition, a tube 241 is provided for continuously injecting steam or a high pressure water jet through outlet opening 65B (see FIG. 5) to shock the slag before the pulsating pressure wave strikes the slag.

An electric motor 251 mounted to the I-beams 181 is provided for rotating the shaft 205 and hence gear 203. Electrical power is applied to the motor 251 from an electrical power source 253, a controllable switch 255 and electrical leads 257.

Combustible gas under pressure is applied to the tube 233 from a source 261 and a valve 263. A timing circuit 265 coupled to the source 253 periodically produces an electrical pulse which is applied to leads 267L for periodically actuating the spark plug 235 for periodically igniting the combustible mixture in chamber 71 for producing the pulsed pressure waves. A compressed air source 233A applies compressed air to tube 231 by way of valve 233V and a source 241S of steam or water under pressure applies steam or water to tube 241 by way of valve 241V. Valves 233V, 241V and 263 may be electrically controlled valves. Suitable circuits may be employed to control the opening and closing of valves 233V, 241V, and 263.

Figures 9, 10, 11:
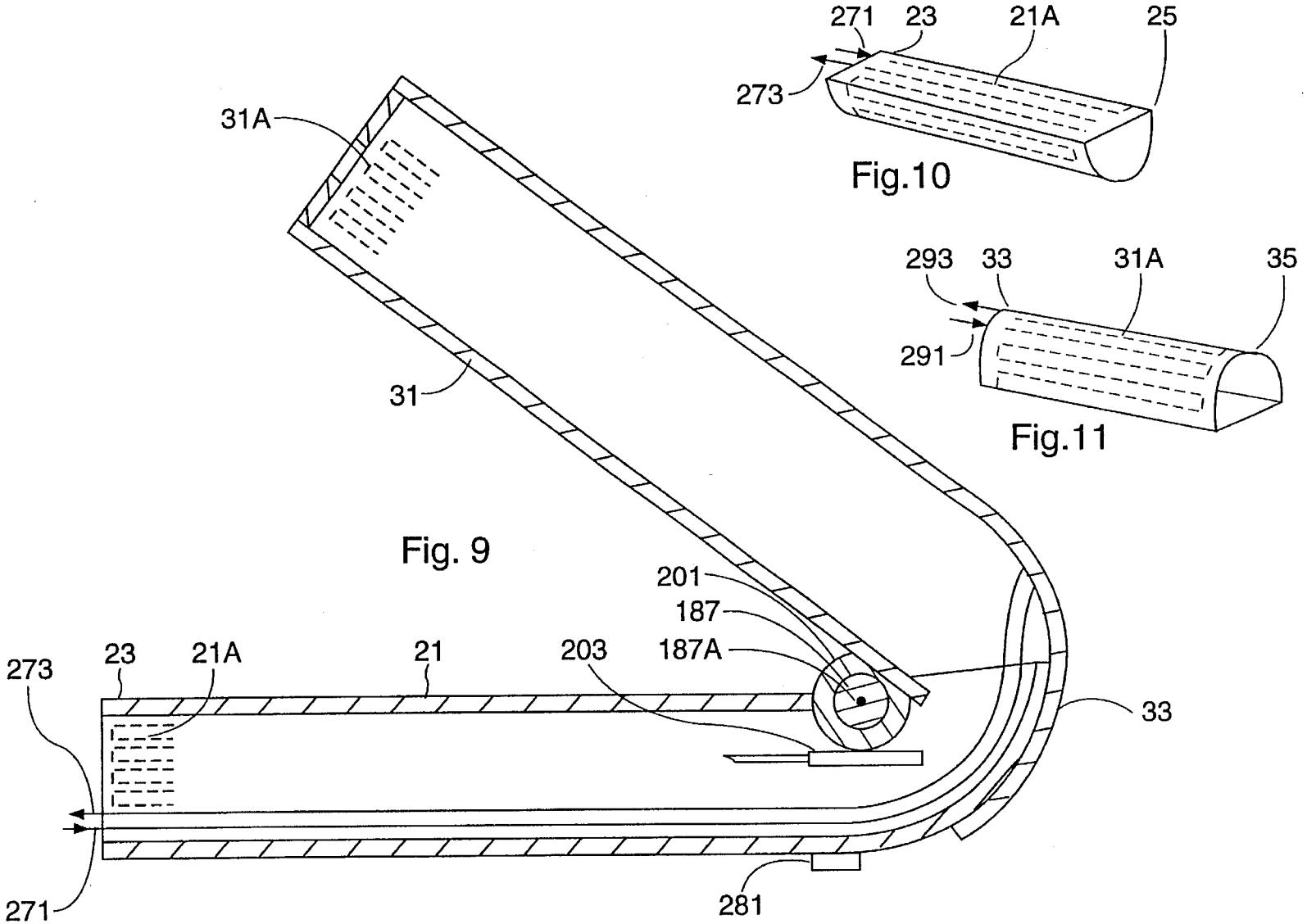
FIG. 9 is a side cross sectional view of the two housing members illustrating the cooling system of the walls thereof.
FIGS. 10 and 11 illustrate the paths of the cooling apertures in the walls of the apparatus of the invention through which water is injected for cooling purposes. In these FIGS., the curved ends of the two housing members are not shown.
Figure 12:
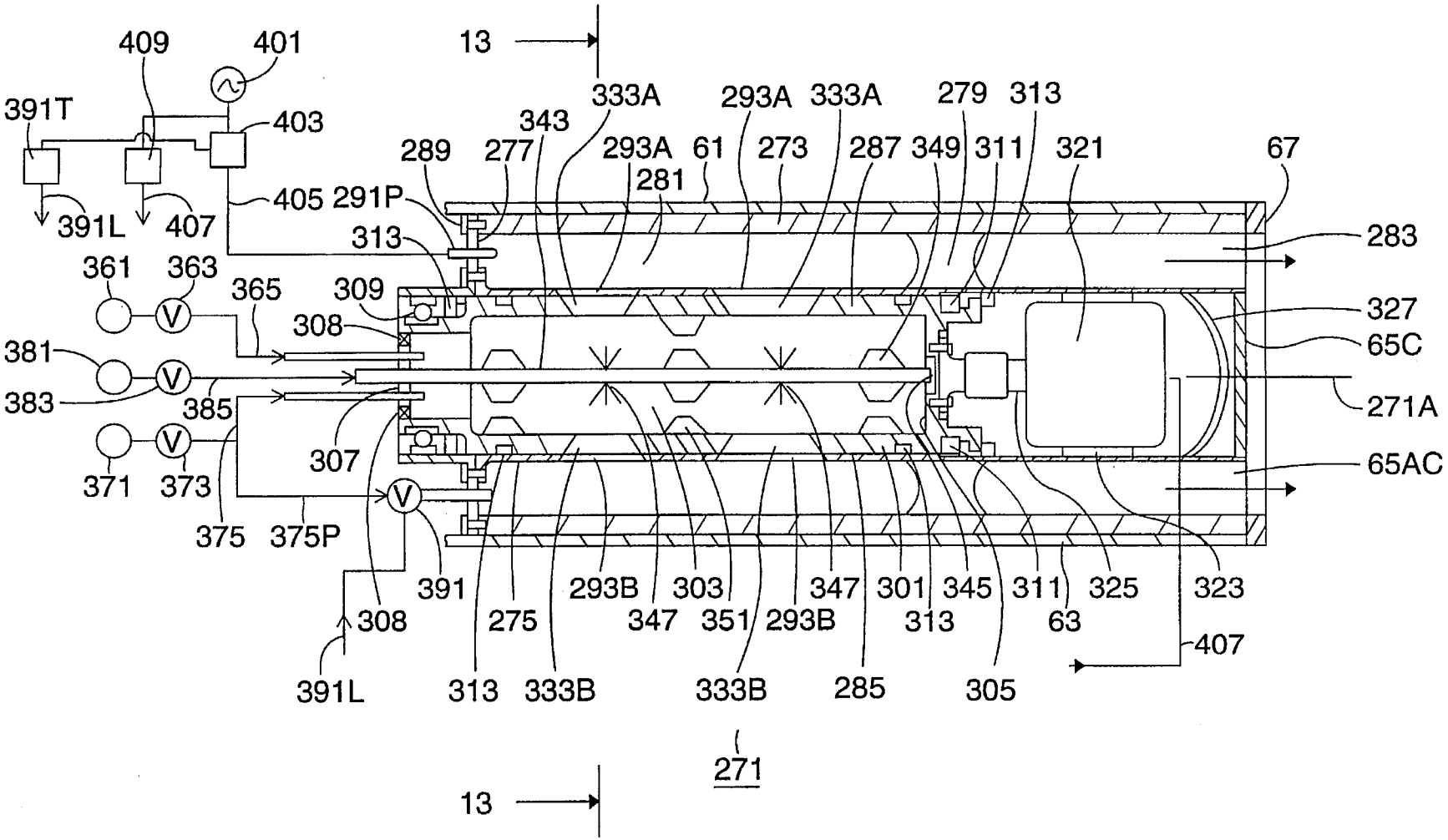
FIG. 12 is a cross-sectional view of a pulsed detonation device of the invention.

Referring to FIGS. 8, 9, 11 and 12, the walls of the members 21 and 31 have apertures 21A and 31A respectively which are formed therein and which wind from one end to another through which water is passed for cooling purposes. For example as shown in FIGS. 8 and 11, the aperture 21A enters at 271 at end 23, winds back and forth between ends 23 and 25 of member 21, and exits at 273. The aperture 31A winds back and forth between ends 33 and 35 of member 31 as shown in FIG. 12. A tube 291 extends to the inlet of aperture 31A and a tube 293 extends to the outlet of aperture 31A to allow the passage of water for cooling purposes.

The walls of members 21 and 31 may be made of advanced materials such as carbon-carbon, inconel, stainless steel, and Haynes 188 alloys. A stop 281 (see FIG. 9) is connected to the end 25 of member 21 to limit movement of the member 31 to its extended position and hence to define the maximum angle theta. The length of the members 21 and 31 may be of the order of seven feet.

The inlet and exhaust tubes 227 and 229 of the combustor 71 may be adjusted to allow different fuels to be used.

Referring now to FIGS. 12–15 there will be described a pulsed detonation device 271 which may be used in housing member 31 instead of the pulsed deflagration device 71 for producing pulsed pressure waves. In FIG. 14, the walls 61 and 63 of member 31 are not shown. The device 271 comprises an outer cylindrical wall 273 having an inner cylindrical wall 275 secured thereon by a rear annular detonation thrust wall 271 and angularly spaced apart brackets 279. The two walls 273 and 275 define a detonation annulus 281 having an outlet opening 283 and a central cavity 285 in which is located rotary valve 287. The front end of the wall 273 is secured to the front wall 67 of the housing member 31 and the front end of the cylindrical wall 275 has a circular wall 65C secured thereto. The front wall 67 of the housing member 31 thus has an annular outlet 65AC through which detonation pressure waves of fluid gas pass for cleaning the boiler walls.

The rear wall 277 is secured to the rear ends of the cylindrical wall 273 and 275 by bolts 289. A plurality of spark plugs 291 extend through the wall 277 for periodically igniting the combustible mixture formed in the annulus 281 for periodically producing detonation waves which proceed down the annulus 281 and out the outlet opening 65AC. The spark plugs 291 are located at spaced apart angular positions around the axis 271A of the device 271.

The inner cylindrical wall 275 has angularly spaced apart openings 293A and 293B formed therethrough around the axis 271A. As shown, openings 293A are aligned and openings 293B are aligned and the mid points of openings 293A and 293B are located 180 degrees apart.

The rotary valve 287 comprises a cylindrical wall 301 having a central cavity 303, a closed front wall 305 and a closed stationary rear wall 307 supported by beatings 308 to allow the rotary valve 287 to rotate relative to the wall 308. Means is provided for maintaining the wall 307 stationary relative to the rotary valve 287. Suitable seals are provided such that a seal is formed between the stationary rear wall 307 and the rear end of the rotary valve 287. Bearings 309 and 311 support the valve 287 for rotation within the wall 275. Members 313 are seals. An electric motor 321 secured in the front end of cylindrical wall 275 by brackets 323 has a shaft 325 connected to the front wall 305 for rotating the valve 287. Member 327 is a heat shield.

The cylindrical wall 301 of the rotary valve 287 has angularly spaced apart openings 333A and 333B formed therethrough around the axis 271A. Openings 333A are aligned and openings 333B are aligned, and the mid points of openings 333A and 333B are located 180 degrees apart.

Thus as the valve 287 rotates 360 degrees openings 333A and 293A and openings 333B and 293B are aligned at 180 degrees to form passageways from the interior 303 of the valve 287 to the detonation chamber 281 twice during each 360 degree revolution. Between these 180 degree positions the valve openings 333A and 333B are closed.

Secured in the interior 303 of the valve 287 is a tubular member 343 having a rear end fixed to the rear wall 307 and a front end supported by a bearing 345 coupled to the front wall 305. The tubular member 243 thus is fixed in position relative to cylindrical walls 273 and 273. The tubular member 343 has openings 347 aligned with openings 293A and 293B formed through the cylindrical wall.

Outwardly extending mixing vanes 349 are secured to the tubular member 343 and inwardly extending mixing vanes 351 are secured to the inside of cylindrical wall 301 of the rotary valve 287.

A combustible fuel under pressure such as propane and air under pressure are fed into the valve 287 from sources 361 and 371, valves 363 and 373 and conduits 365 and 375 respectively. Oxygen is fed into the tube 343 for injection into the interior 303 by way of aperture 347. A source of oxygen 381 is coupled to the tube 343 by way of valve 383 and conduit 385. Purge air is fed into the detonation chamber 281 by way of conduit 375P and an electrically controllable valve 291 coupled to spaced apart inlets 292 extending through the rear wall 307. Electrical current is periodically applied to the spark plugs from a source 401, timer 403 and leads 405. The timer 403 also periodically controls openings of the valve 391. The motor 321 is energized by way of electrical current applied thereto from source 401, leads 407 and a control switch 409.

The valve 391 is electrically controlled by timer 391T coupled to timer 403 and leads 391L coupled from the timer 391T to the valve 391.

The components 361, 363, 371, 373, 381, 383, 401, 403, 409 and 391T are located outside of the housing members 21 and 31 and leads 405, 407, 391L and conduits 365, 375, 375P and 385 extend to the device 271 through the housing members 21 and 31.

In operation, the switch 409 is closed to energize the motor 321 to rotate the valve 287. The valves 363, 373, and 383 are opened to inject fuel, air, and oxygen into the interior of the valve for mixture by vanes 349 and 351 for flow into the detonation chamber 281 when the valve openings 333A and 333B are opened. When the valve openings 333A and 333B are closed, the spark plugs 291 are energized to ignite and detonate the combustible mixture in the detonation chamber 281. This causes a detonation wave to propagate out of the chamber 281 at relative high supersonic speed. The detonation wave compresses the fluid as it moves outward toward the exit. The air purge valves 391 then are opened to remove the residual high temperature gaseous combustion products in the chamber 281 and the cycle is repeated as the valve openings 333A and 333B are closed and then opened.

The high pressure detonation wave may be 20 times atmospheric pressure. The force of the wave is about 40 times ambient pressure times the exhaust area, which is the approximate area on the slag wall to be cleaned. The exit temperature may be about 3620 degrees Fahrenheit. A small water jet may be used to shock the slag before the detonation wave impingement. The device 271 may have a diameter of about 3 inches. There may be 1, 2, 3, or 4 rotary valve openings around the circumference as may be required by the design. Typically two openings may occur simultaneously per revolution to admit the gaseous premixed fuel.

Thus the detonation device delivers much stronger waves at the slag than the deflagration device.

In one embodiment, the housing members 21 and 31 each may have an outside diameter of about 8 inches and a length of about 7 feet.

I claim:

1. An apparatus for cleaning the interior walls of a heat producing system of the type having an inlet opening extending through a wall thereof, comprising:

a first housing member having first and second opposite ends with an axis of rotation extending between said first and second ends and a second housing member having third and fourth opposite ends, pivotal support means for pivotally coupling said second and third ends of said first and second housing members together for pivotal movement of said second housing member in a given plane relative to said first housing member to allow said second housing member to be moved to a folded position with said fourth end being located near said first housing member and to an extended position with said fourth end being located away from said first housing member, means for moving said second housing member to said folded and extended positions, means for moving said first and second housing members into and out of the heat producing system by way of the opening thereof when said second housing member is in said folded position, means for rotating said first housing member and hence said second housing member about said axis when said first and second housing members are located in the interior of the heat producing system, and means for injecting fluid through said fourth end of said second housing member when said first and second housing members are located in the interior of the heat producing system for cleaning the walls thereof.

2. The apparatus of claim 1, wherein:

said first housing member comprises surrounding walls extending between said first and second ends forming an interior space therebetween, said second housing member comprises surrounding walls extending between said third and fourth ends forming an interior space therebetween, said pivotal support means comprises a first pivot member coupled to one of said housing members and having an axis extending transverse to said given plane and a second pivot member surrounding said first pivot member and being fixedly coupled to the other of said housing members such that said first and second pivot members can rotate relative to each other to allow said second housing member to be moved between said folded and extended positions in said given plane, a first gear coupled to one of said pivot members, and a second gear supported to mesh with said first gear such that rotation of said second gear in a first direction rotates said first gear in a direction to move said second housing member toward said folded position and rotation of said second gear in a direction opposite said first direction rotates said first gear in a direction to move said second housing member toward said extended position.

3. The apparatus of claim 1, wherein:

said first housing member comprises first surrounding walls extending between said first and second ends forming an interior space therebetween, said second housing member comprises second surrounding walls extending between said third and fourth ends forming an interior space therebetween, said first and second surrounding walls comprise first and second generally flat wall portions which face each other when said second housing member is in said folded position.

4. The apparatus of claim 1, wherein:

said first housing member comprises first surrounding walls extending between said first and second ends forming an interior space therebetween, said second housing member comprises second surrounding walls extending between said third and fourth ends forming an interior space therebetween, said second surrounding walls at said third end of said second housing members comprises wall structure which overlaps wall structure of said first surrounding walls of said first housing member at said second end when said second housing member is in said folded and extended positions.

5. The apparatus of claim 3, wherein:

said first and second surrounding walls comprise first and second generally half cylindrical wall portions which extend from said first and second generally flat wall portions respectively.

6. The apparatus of claim 5, wherein:

said second generally half cylindrical wall portion at said third end overlaps said first generally half cylindrical wall portion at said second end when said second housing member is in said folded and extended positions.

7. The apparatus of claim 1, comprising:

a pulsed combustor located in said second housing member for periodically producing a deflagration pressure wave for application through said fourth end of said second housing member, means for applying a combustible fuel and air under pressure to said pulsed combustor by way of said first and second ends of said first housing member and said third end of said second housing member to form a combustible mixture in said combustor, and means for periodically igniting said combustible mixture in said combustor for periodically producing a deflagration pressure wave.

8. The apparatus of claim 4, comprising:

a pulsed combustor located in said second housing member for periodically producing a deflagration pressure wave for application through said fourth end of said second housing member, means for applying a combustible fuel and air under pressure to said pulsed combustor by way of said first and second ends of said first housing member and said third end of said second housing member to form a combustible mixture in said combustor, and means for periodically igniting said combustible mixture in said combustor for periodically producing a deflagration pressure wave.

9. The apparatus of claim 1, comprising a pulsed detonating apparatus located in said second housing member for periodically producing a detonation pressure wave for application through said fourth end of said second housing member, said pulsed detonating apparatus comprising:

a detonator housing member having a surrounding outer wall, a rear end and an outlet end, an intermediate cylindrical wall spaced inward from said outer wall, a rear wall connected between said outer wall and said intermediate wall defining a detonation chamber between said outer wall, said intermediate wall and said rear wall with an outlet opening at said outlet end, spaced apart inlet openings formed through said intermediate wall, a rotatable valve located in said intermediate wall and comprising an inner cylindrical wall having a closed from end, a closed rear end and spaced apart outlet openings formed through said inner cylindrical wall, said outlet and inlet openings being located and sized to allow each of said outlet openings to align with at least one of said inlet openings upon rotation of said valve to alternately allow and prevent fluid communication from the interior of said valve to said detonation chamber, means for rotating said rotatable valve within said intermediate cylindrical wall, means for feeding air, fuel and oxygen into the interior of said rotatable valve for forming a combustible mixture for passage into said detonation chamber, ignition means located in said detonation chamber for igniting said combustible mixture in said detonation chamber when said inlet and outlet openings are in non-aligned positions for forming a detonation wave in said detonation chamber for flow out of said outlet opening, and a purge valve means coupled to the rear end of said detonation chamber for injecting air therein after the detonation wave is produced and when said inlet and outlet valves are in non-aligned positions to remove the residual high temperature gaseous combustion products.

10. The apparatus of claim 9, comprising:

a central member located in the interior of said rotatable valve and having outwardly extending mixing vanes coupled thereto, and inwardly extending vanes coupled to the inside of said intermediate cylindrical wall for cooperation with said outwardly extending vanes of said central member for mixing the air, fuel and oxygen fed into the interior of said rotatable valve.

11. The apparatus of claim 10, comprising:

means for maintaining said central member in a stationary position relative to said intermediate cylindrical wall.

12. The apparatus of claim 10, wherein:

said central member comprises a tubular member having outlet openings formed through the wall thereof, and means for feeding oxygen into the interior of said tubular member for flow into the interior of said rotatable valve by way of said outlet openings formed through the wall of said tubular member.

13. The apparatus of claim 11, wherein:

said central member comprises a tubular member having outlet openings formed through the wall thereof, and means for feeding oxygen into the interior of said tubular member for flow into the interior of said rotatable valve by way of said outlet openings formed through the wall of said tubular member.

14. An apparatus for cleaning the interior walls of a heat producing system of the type having an inlet opening extending through a wall thereof, comprising:

a detonator housing member having a surrounding outer wall, a rear end and an outlet end, an intermediate cylindrical wall spaced inward from said outer wall, a rear wall connected between said outer wall and said intermediate wall defining a detonation chamber between said outer wall, said intermediate wall and said rear wall with an outlet opening at said outlet end, spaced apart inlet openings formed through said intermediate wall, a rotatable valve located in said intermediate wall and comprising an inner cylindrical wall having a closed front end, a closed rear end and spaced apart outlet openings formed through said inner cylindrical wall, said outlet and inlet openings being located and sized to allow each of said outlet openings to align with at least one of said inlet openings upon rotation of said valve to alternately allow and prevent fluid communication from the interior of said valve to said detonation chamber, means for rotating said rotatable valve within said intermediate cylindrical wall, means for feeding air, fuel and oxygen into the interior of said rotatable valve for forming a combustible mixture for passage into said detonation chamber, ignition means located in said detonation chamber for igniting said combustible mixture in said detonation chamber when said inlet and outlet openings are in non-aligned positions for forming a detonation wave in said detonation chamber for flow out of said outlet opening, a purge valve means coupled to the rear end of said detonation chamber for injecting air therein after the detonation wave is produced and when said inlet and outlet valves are in non-aligned positions to remove the residual high temperature gaseous combustion product, and means for moving said housing member into and out of said heat producing system by way of the opening thereof.

15. The apparatus of claim 14, comprising:

a central member located in the interior of said rotatable valve and having outwardly extending mixing vanes coupled thereto, and inwardly extending vanes coupled to the inside of said intermediate cylindrical wall for cooperation with said outwardly extending vanes of said central member for mixing the air, fuel and oxygen fed into the interior of said rotatable valve.

16. The apparatus of claim 15, comprising:

means for maintaining said central member in a stationary position relative to said intermediate cylindrical wall.

17. The apparatus of claim 15, wherein:

said central member comprises a tubular member having outlet openings formed through the wall thereof, and means for feeding oxygen into the interior of said tubular member for flow into the interior of said rotatable valve by way of said outlet openings formed through the wall of said tubular member.

18. The apparatus of claim 16, wherein:

said central member comprises a tubular member having outlet openings formed through the wall thereof, and means for feeding oxygen into the interior of said tubular member for flow into the interior of said rotatable valve by way of said outlet openings formed through the wall of said tubular member.

* * * * *